US006747253B1

(12) United States Patent
Firth et al.

(10) Patent No.: US 6,747,253 B1
(45) Date of Patent: Jun. 8, 2004

(54) METHOD AND APPARATUS FOR INDUCTION HEAT TREATMENT OF STRUCTURAL MEMBERS

(75) Inventors: Lee C. Firth, Renton, WA (US); John R. Fischer, Winthrop, WA (US); Paul S. Gregg, Normandy Park, WA (US); Marc R. Matsen, Seattle, WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 10/431,295

(22) Filed: May 7, 2003

(51) Int. Cl.[7] ..... H05B 6/10
(52) U.S. Cl. ..... 219/634; 219/635; 219/659
(58) Field of Search ..... 219/602, 603, 219/615–617, 632, 634, 635, 659, 646, 667, 645, 647; 72/21.1, 60, 54, 709; 228/157, 193, 252.71

(56) References Cited

U.S. PATENT DOCUMENTS

| | | | | |
|---|---|---|---|---|
| 3,753,798 | A | | 8/1973 | Komatsu et al. |
| 3,934,441 | A | | 1/1976 | Hamilton et al. |
| 4,142,923 | A | | 3/1979 | Satava |
| 4,306,436 | A | * | 12/1981 | Schulz et al. ..... 72/21.1 |
| 4,658,362 | A | | 4/1987 | Bhatt |
| 4,713,953 | A | | 12/1987 | Yavari |
| 4,811,890 | A | | 3/1989 | Dowling et al. |
| 4,820,355 | A | | 4/1989 | Bampton |
| 4,901,552 | A | * | 2/1990 | Ginty et al. ..... 72/60 |
| 4,956,008 | A | | 9/1990 | McQuilkin |
| 5,025,974 | A | | 6/1991 | Strickland |
| 5,098,011 | A | | 3/1992 | Runyan |
| 5,115,963 | A | | 5/1992 | Yasui |
| 5,118,026 | A | * | 6/1992 | Stacher ..... 228/157 |
| 5,181,647 | A | | 1/1993 | Runyan |
| 5,181,969 | A | | 1/1993 | Komatsubara et al. |
| 5,277,045 | A | | 1/1994 | Mahoney et al. |
| 5,289,965 | A | | 3/1994 | Yasui et al. |
| 5,309,747 | A | | 5/1994 | Yasui |
| 5,338,497 | A | | 8/1994 | Murray et al. |
| 5,410,132 | A | | 4/1995 | Gregg et al. |
| 5,419,170 | A | | 5/1995 | Sanders et al. |
| 5,420,400 | A | | 5/1995 | Matsen |
| 5,467,626 | A | | 11/1995 | Sanders |
| 5,530,227 | A | | 6/1996 | Matsen et al. |
| 5,556,565 | A | | 9/1996 | Kirkwood et al. |
| 5,638,724 | A | | 6/1997 | Sanders |
| 5,645,744 | A | | 7/1997 | Matsen et al. |
| 5,661,992 | A | | 9/1997 | Sanders |
| 5,683,607 | A | | 11/1997 | Gillespie et al. |
| 5,683,608 | A | | 11/1997 | Matsen et al. |
| 5,688,426 | A | | 11/1997 | Kirkwood et al. |
| 5,692,406 | A | | 12/1997 | Yasui |
| 5,700,995 | A | | 12/1997 | Matsen |
| 5,705,794 | A | | 1/1998 | Gillespie et al. |
| 5,710,414 | A | | 1/1998 | Matsen et al. |
| 5,728,309 | A | | 3/1998 | Matsen et al. |
| 5,737,954 | A | | 4/1998 | Yasui |
| 5,772,950 | A | | 6/1998 | Brustad et al. |
| 5,797,239 | A | | 8/1998 | Zaccone et al. |
| 5,808,281 | A | | 9/1998 | Matsen et al. |
| 5,823,032 | A | | 10/1998 | Fischer |
| 5,829,716 | A | | 11/1998 | Kirkwood et al. |
| 5,881,459 | A | | 3/1999 | Yasui |
| 5,890,285 | A | | 4/1999 | Pruitt et al. |

(List continued on next page.)

*Primary Examiner*—Tu Ba Hoang
(74) *Attorney, Agent, or Firm*—Alston & Bird LLP

(57) ABSTRACT

An apparatus and method for heat treating a structural member, for example, to relieve stresses therein, are provided. The structural member is restrained in a die cavity by one or more inflatable bladders so that a desired dimensional accuracy is achieved. The structural member can be heated by an electromagnetic field generator, such as an induction coil, that heats one or more susceptors to a characteristic Curie temperature. The apparatus can be used to process structural members of various sizes and shapes, and the heating and cooling cycle can be performed relatively quickly.

28 Claims, 20 Drawing Sheets

U.S. PATENT DOCUMENTS 5,904,992 A 5/1999 Yasui
5,914,064 A 6/1999 Gillespie et al.
6,087,640 A 7/2000 Gillespie et al.
6,180,932 B1 1/2001 Matsen et al.
6,322,645 B1 11/2001 Dykstra et al.
6,337,471 B1 1/2002 Kistner et al.
6,528,771 B1 * 3/2003 Matsen et al. ..... 219/667

* cited by examiner

METHOD AND APPARATUS FOR INDUCTION HEAT TREATMENT OF STRUCTURAL MEMBERS

BACKGROUND OF THE INVENTION

1) Field of the Invention

The present invention relates to heat treating of structural members and, more particularly, relates to an apparatus and associated method for mechanically restraining structural members during induction heat treatments such as a stress relief cycle.

2) Description of Related Art

Residual stresses can result in structural members from various manufacturing and treatment processes. For example, if pieces of stock material are welded to form a more complex structural member, the member can include residual stresses that result from the welding process. These residual stresses can cause undesirable changes to the dimensional characteristics and material properties of the member. Conventional heat treatments are well known as a method of relieving stresses and thereby changing the mechanical and material properties of materials. For example, the structural member can be heated to a heat treatment temperature and then cooled. However, if the member is not mechanically restrained during the thermal cycle, the dimensions of the member may change during the heat treatment.

According to one proposed method of stress relief, tooling is positioned proximate to the structural member such that the tooling restrains the structural member. The structural member and the tooling are then heated in a furnace to the heat treatment temperature. The tooling restrains the structural member during the heating and subsequent cooling to maintain the dimensional accuracy. However, it can be difficult to provide tooling that is sufficiently strong and dimensionally accurate throughout the temperature range of the heat treatment cycle. Additionally, each structural member that is formed can require unique tooling for restraint during heat treatment, adding to the overall cost of the structural members. Further, even if such tooling can be provided, the process is time-consuming because it takes time for the furnace to heat the member and tooling to the heat treatment temperature. The time required for the subsequent cooling of the furnace, member, and tooling can also be lengthy.

Thus, there exists a need for an apparatus and associated method for heat treating structural members of various shapes and sizes. The apparatus should maintain the dimensional accuracy of the members during heat treatments such as a stress relief cycle. Preferably, the method should not be overly time-consuming.

SUMMARY OF THE INVENTION

The present invention provides an apparatus and method for heat treating a structural member, for example, to relieve stresses in the structural member. The structural member can be restrained during a heating and cooling cycle so that a desired dimensional accuracy is achieved. Further, structural members of various sizes and shapes can be restrained, and the heating and cooling cycle can be performed relatively quickly.

According to one embodiment, the apparatus includes first and second co-operable dies that are structured to define a die cavity therebetween for at least partially receiving the structural member. At least one susceptor is in thermal communication with the die cavity. Each susceptor has a Curie temperature at which the susceptor becomes paramagnetic, and the Curie temperature can be about equal to the heat treatment temperature of the structural member. An electromagnetic field generator, such as at least one induction coil, is configured to induce a current within at least a portion of the susceptors. A coolant source can be fluidly connected to the coils and configured to circulate a cooling fluid through a passage of the coils to cool the coils. At least one rigid tool is positioned in the die cavity proximate to the structural member. Each tool defines a surface corresponding to at least a portion of the structural member. Further, at least one bladder is positioned in the die cavity, each bladder configured to receive a pressurized fluid for expanding the bladder and thereby urging the structural member against the corresponding surfaces of the tools so that a distortion of the structural member is restrained while the structural member is heat treated.

According to one aspect, a pressure source is fluidly connected to the bladders to supply the pressurized fluid to the bladders. Two or more bladders can be positioned in the die cavity, and a pressure regulation device in fluid communication with each bladder can be configured to maintain a substantially equal pressure in each bladder. The bladders can also be configured opposite a portion of the structural member so that the bladders restrain the structural member therebetween, or the bladders can be configured between opposed portions of the structural member so that the bladders urge the opposed portions to a predetermined dimension. The bladders can be formed of titanium or titanium alloys.

According to another aspect, an inflatable susceptor engagement seal is disposed at an interface of first and second portions of the at least one susceptor and configured to be inflated to electrically engage the first and second portions. An inflatable cavity seal can be disposed at an interface of the first and second dies and configured to receive a pressurized fluid to inflate the seal to hermetically seal the die cavity.

The present invention also provides a method of heat treating a structural member. According to one embodiment, the method includes providing the structural member at least partially in a die cavity, positioning at least one bladder in the die cavity proximate to the structural member, and injecting a pressurized fluid into the at least one bladder and thereby expanding the bladder to at least partially fill a space in the die cavity and restrain the structural member in a predetermined configuration.

One or more tools are also positioned in the die cavity proximate to the structural member so that the structural member is urged against a corresponding surface of the tools. An electromagnetic field generator, such as at least one induction coil, is energized to induce a current within at least a portion of the susceptor to heat the structural member to a heat treatment temperature, such as a Curie temperature at which the susceptor becomes paramagnetic. A cooling fluid can also be circulated through the at least one induction coil. Thus, the structural member is restrained by the at least one bladder at least partially during the energizing of the coil so that the bladder restrains a distortion of the structural member. The structural member can be maintained at the heat treatment temperature for a predetermined interval to relieve stresses in the structural member. The structural member can also be cooled according to a predetermined temperature schedule while restraining the structural member with the bladders in the die cavity.

According to one aspect, at least two bladders are positioned in the die cavity, for example, opposite a portion of the structural member so that the bladders restrain the structural member therebetween. A substantially equal pressure can be maintained in each of the bladders. The bladders can be formed of titanium or titanium alloys. According to another aspect, an inflatable susceptor engagement seal is disposed at an interface of first and second portions of the susceptor and pressurized to electrically engage the first and second portions. The die cavity can be formed by engaging first and second cooperable dies, and an inflatable cavity seal at an interface of the dies can be pressurized to hermetically seal the die cavity. Gas can be purged from the die cavity, for example, before the bladders are expanded.

Before the structural member is placed in the die cavity, a fixture member that corresponds in shape to the structural member can be positioned in the die cavity. The bladders can be positioned in the die cavity proximate the fixture member and formed by heating the bladders to a forming temperature higher than the heat treatment temperature of the structural member and injecting a fluid to at least partially expand the bladders and urge the bladders at least partially against the fixture member. The fixture member is then removed from the die cavity. A forming susceptor having a Curie temperature about equal to the forming temperature can be provided in thermal communication with the die cavity, and a current can be induced in the forming susceptor to heat the bladders to the forming temperature.

BRIEF DESCRIPTION OF THE DRAWINGS

The foregoing and other advantages and features of the invention, and the manner in which the same are accomplished, will become more readily apparent upon consideration of the following detail description of the invention taken in conjunction with the accompanying drawings, which illustrate preferred and exemplary embodiments and which are not necessarily drawn to scale, wherein.

DETAILED DESCRIPTION OF THE INVENTION

The present invention now will be described more fully hereinafter with reference to the accompanying drawings, in which some, but not all embodiments of the invention are shown. This invention may be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
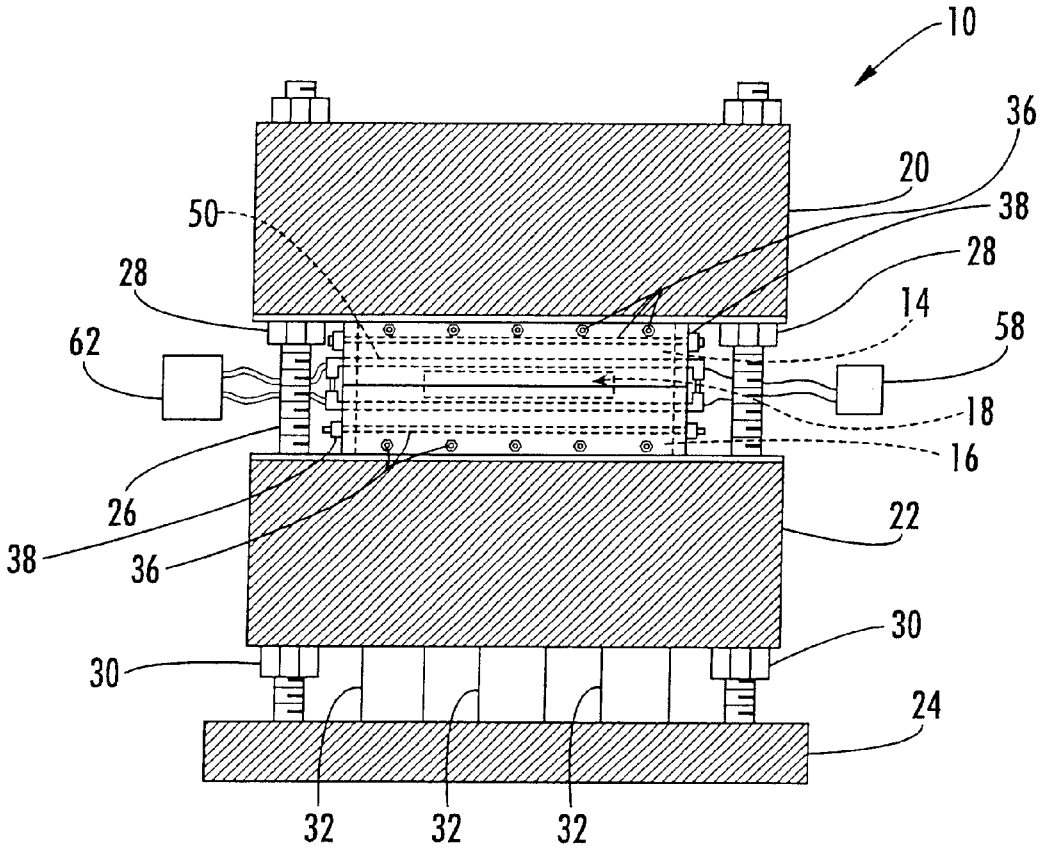
FIG. 1 is an elevation view illustrating an apparatus for heat treating a structural member, according to one embodiment of the present invention.
Figure 2:
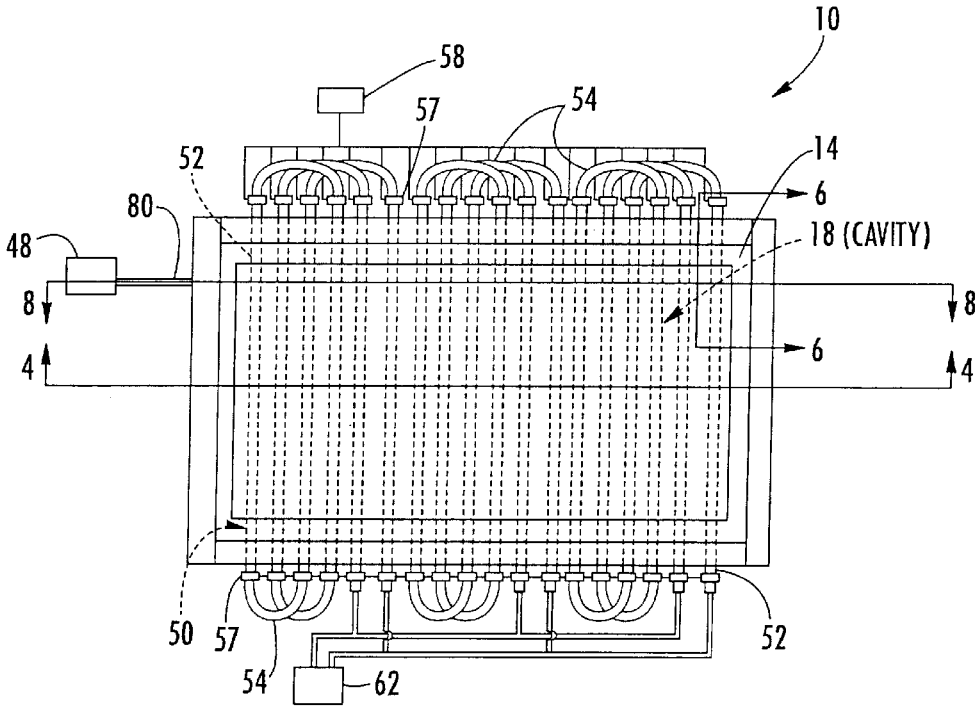
FIG. 2 is a plan view illustrating the apparatus of FIG. 1.

Referring now to the drawings, and in particular to FIGS. 1 and 2, there is illustrated a heat treatment apparatus 10, according to one embodiment of the present invention. The apparatus 10 can be used to heat treat at least one structural member 12 to improve the material properties of the structural members 12, for example, by relieving stresses induced during preceding manufacturing processes. The apparatus 10 includes first and second dies 14, 16 that are co-operable and configured to define a die cavity 18 therebetween that is structured to at least partially receive the at least one structural member 12. The first and second dies 14, 16 are generally mounted on and supported by first and second strongbacks 20, 22 respectively, which may be secured using a mechanical support structure comprising a base 24 and perpendicular members 26. A "strongback" is a stiff plate, such as a metal plate, that acts as a mechanical constraint to keep the first and second dies 14, 16 together and to maintain the dimensional accuracy of the dies 14, 16.

Various methods can be used for configuring the dies 14, 16. For example, as shown in FIG. 1, first nuts 28 that are adjustable on the perpendicular members 26 are structured to support the first strongback 20 and the first die 14. Second nuts 30 support the second strongback 22 and the second die 16. The second strongback 22 can translate on the perpendicular members 26 so that as the second nuts 30 are adjusted away from the first strongback 20, the second strongback 22 can be separated from the first strongback 20 and, hence, the dies 14, 16 can be opened. Similarly, the second nuts 30 can be adjusted toward the first strongback 20 to adjust the second strongback 22 toward the first strongback 20 and thereby adjust the second die 16 toward the first die 14 to close the die cavity 18. If the strongbacks 20, 22 are oriented as shown in FIG. 1 so that the second strongback 22 is below the first strongback 20, gravity can be used to adjust the second strongback 22 away from the first strongback 20, i.e., downward, to open the dies 14, 16. Air bladders 32 can be provided between the base 24 and the second strongback 22 to adjust the second strongback 22 toward the first strongback 20 and close the dies 14, 16. The air bladders 32 are fluidly connected to a source of pressurized air (not shown) and configured so that filling the bladders 32 with air urges the second strongback 22 away from the base 24, and releasing air from the bladders 32 allows the second strongback 22 to be adjusted toward the base 24. Alternatively, other types or arrangements of bladders can be used to adjust the dies 14, 16, or other adjustment devices can be used such as hydraulic cylinders, mechanical jacks, levers, and the like.

Figure 3:
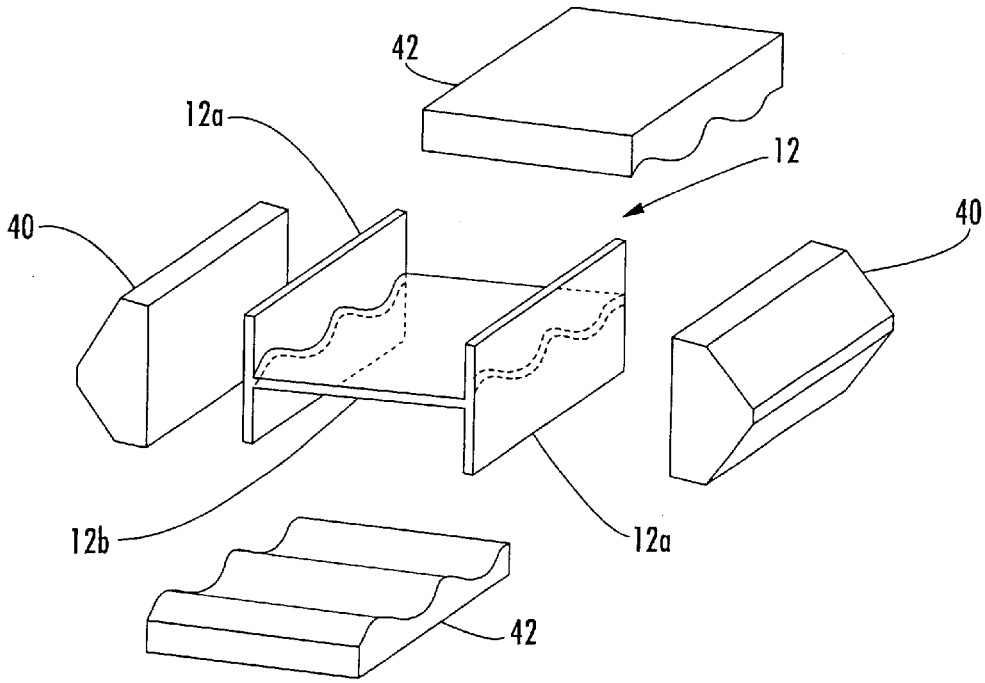
FIG. 3 is an exploded perspective view illustrating a structural member and four tools according to one embodiment of the present invention.
Figure 3A:
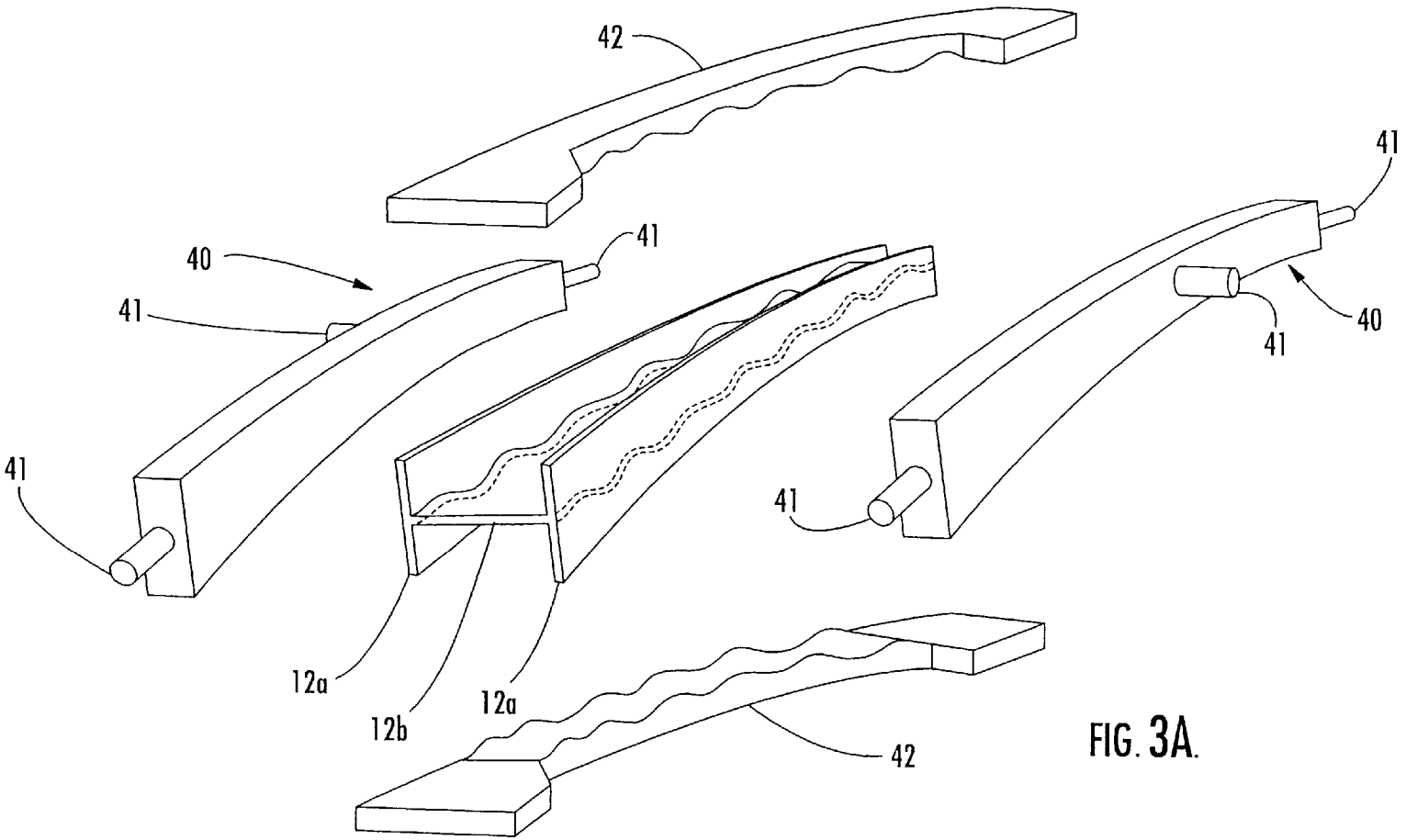
FIG. 3A is an exploded perspective view illustrating the structural member and tools of FIG. 2A.

The term "structural member" is not meant to be limiting, and it is understood that the die cavity 18 can at least partially receive one or more structural members 12 at a time. The structural members 12 processed in the die cavity 18 can be simple or complex, and can be formed of such materials as titanium, titanium alloys, aluminum, aluminum alloys, steel, other metals, composites, and the like. In one embodiment of the invention, the structural member 12 is formed by connecting multiple stock or specially formed members. The structural members 12 can be connected by various types of weld joints, including arc weld joints, friction weld joints, and the like, or by fasteners such as rivets, bolts, screws, and the like. According to one embodiment, the structural member 12 is a titanium spar with longitudinally opposed caps that are welded to a corrugated web, as shown in FIGS. 3 and 3A. As shown in FIG. 3A, the structural member 12 can be a curved or tapered spar. The spars can be used in a variety of applications, for example, as a structural support in an aircraft wing, aircraft fuselage, other aeronautical vehicles, and the like. Structural members for a wide variety of other applications can be fabricated including, without limitation, structural members for automotive or marine applications or the like.

The first and second dies 14, 16 preferably are formed of a material having a low thermal expansion, high thermal insulation, and a low electromagnetic absorption. For example, the dies 14, 16 can be formed of a material having a thermal expansion of less than about 0.45/(° F.×$10^6$) throughout a temperature range of between about 0° F. and 1850° F., a thermal conductivity of about 4 Btu/(hr)(ft)(° F.) or less, and substantially no electromagnetic absorption. According to one embodiment of the present invention, the dies 14, 16 are formed of cast ceramic, for example, using a castable fusible silica product such as Castable 120 available from Ceradyne Thermo Materials of Scottdale, Ga. Castable 120 has a coefficient of thermal expansion less than about 0.45/(° F.×$10^6$), a thermal conductivity of about 0.47 Btu/(hr)(ft)(° F.), and a low electromagnetic absorption.

The dies 14, 16 can be at least partially contained within an outer structure such as a box-like structure 34 formed of phenolic material. Further, the dies 14, 16 and phenolic box 34 can be reinforced with fibers and/or fiberglass reinforcing rods 36. The rods 36 can extend both longitudinally and transversely through the phenolic structure 34 and the first and second dies 14, 16, as illustrated in FIG. 1. To provide a post-stressed compressive state to the first and second dies 14, 16, the rods 36 can be placed through the phenolic structure 34 and secured within the first and second dies 14, 16 at the time of casting. Thereafter, nuts 38 at the ends of the rods 36 can be tightened to provide the post-stressed compressive state to prevent cracking or other damage to the dies 14, 16. The first and second dies 14, 16, the phenolic structure 34, and the reinforcement rods 36 are described in U.S. Pat. No. 5,683,608 entitled "Ceramic Die for Induction Heating Work Cells," which issued on Nov. 4, 1997, and which is assigned to the assignee of the present invention and is incorporated herein by reference.

The first and second dies 14, 16 can define one or more surfaces that correspond to the shape of the structural member 12. Additionally, the apparatus 10 can include one or more tools 40, 42, illustrated in FIGS. 3 and 3A, that can be configured in the die cavity 18 with the structural member 12. The tools 40, 42 define corresponding surfaces that are structured to correspond to the structural member 12 or to a desired configuration of the structural member 12. For example, end tools 40 correspond to the flat caps 12*a* of the spar-shaped structural members 12 of FIGS. 3 and 3A, and side tools 42 correspond to the corrugated web 12*b* of the structural members 12. As shown in FIG. 3A, the tools 40, 42 can also be curved or tapered to correspond to the shape of the structural member 12. The tools 40, 42 can be formed of a rigid material that is adapted to withstand the temperature and pressure associated with the heat treatment process without substantial deformation. Further, each tool 40, 42 can have a low coefficient of thermal expansion. For example, the tools 40, 42 can be formed of 420 stainless steel.

Additionally, while the tools 40, 42 can correspond to the complex or detailed contours of the structural members 12, each tool 40, 42 can also correspond to the die cavity 18 so that the tools 40, 42 and, hence, the structural member 12, are restrained in the die cavity 18 during processing. Advantageously, the tools 40, 42 can generally have simple features that correspond to the die cavity 18 so that different tools can be used in a single die cavity 18 to correspond to different structural members 12. Thus, the dies 14, 16 can define contours that are easy to form and resilient to wear and degradation, while the tools 40, 42 define the specific contours that correspond to the structural members 12. Further, the tools 40, 42 can include one or more locating features 41 as shown in FIG. 3A. Each locating feature 41 can be a flange, pin, or other portion that engages a corresponding aperture or contour defined by the dies 14, 16 so that the tools 40, 42 can be located as desired in the die cavity 18.

Figure 4:
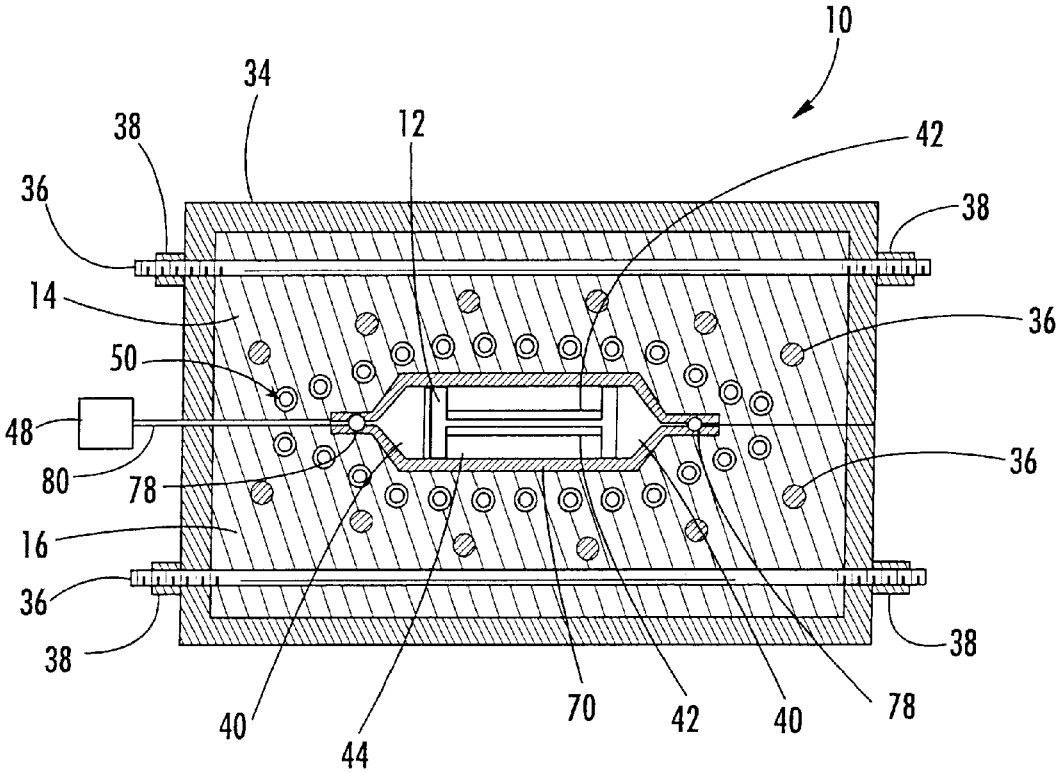
FIG. 4 is a section view illustrating the apparatus of FIG. 1 as seen along line 4—4 of FIG. 2, shown with the bladders expanded.

The tools 40, 42 can be urged against the structural member 12 by one or more inflatable bladders 44 to restrain the structural member 12 and prevent the structural member 12 from distorting during the heat treatment process. Thus, the structural member 12 can be heat treated and cooled in a desired, predetermined shape. For example, as shown in FIG. 4, the tools 40, 42 and the structural member 12 are configured in the die cavity 18 and two bladders 44 are positioned in an opposing configuration relative to the web portion 12*b* of the structural member 12. As shown, the bladders 44 can be expanded between the structural member and the dies 14, 16. The bladders 44 can be configured to contact the structural member 12 or to contact one or more of the tools 40, 42 and urge the tools 40, 42 against the structural member 12. Further, the bladders 44 can be positioned between portions of the structural member 12, for example, between the end caps 12*a* as shown, such that the expansion of the bladders 44 urges the end caps 12*a* outward and to a desired configuration defined by the tools 40 and/or the dies 14, 16.

Figure 4A:
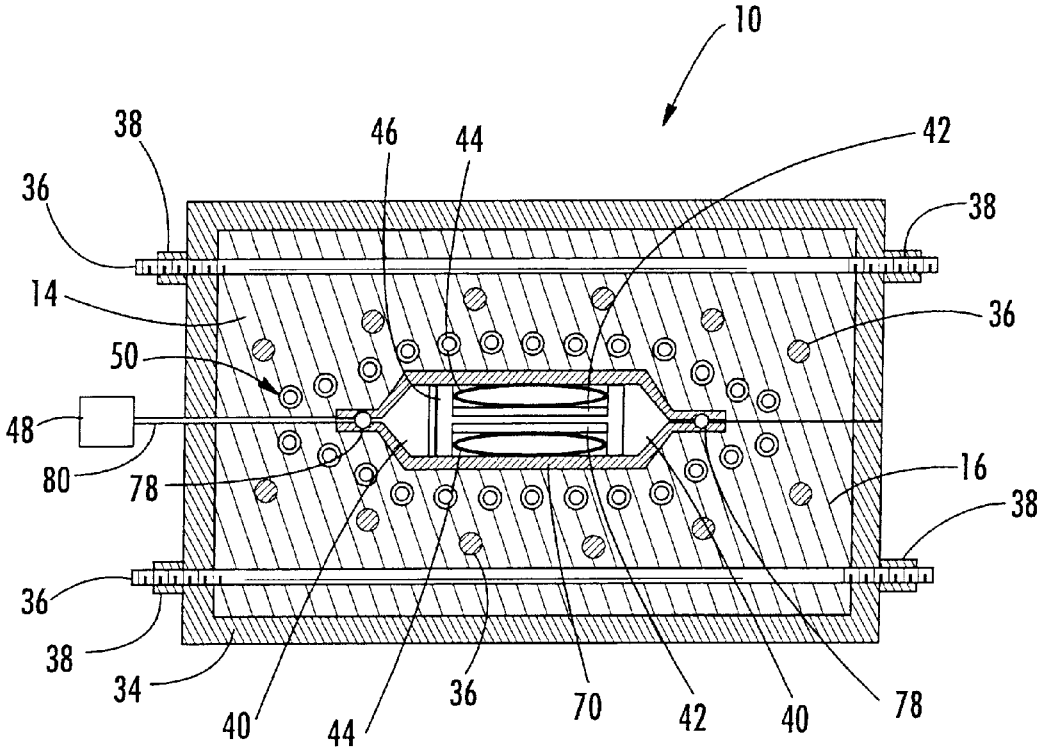
FIG. 4A is a section view illustrating the apparatus of FIG. 1, shown with the bladders partially expanded against a fixture member in the die cavity.

The bladders 44 can be formed of a pliable material that can withstand the temperatures associated with heat treating the particular structural member 12 that is being treated. For example, the bladders 44 can be formed of titanium or titanium alloys, such as Ti 6-4 (6% aluminum, 4% vanadium, balance titanium). According to one embodiment of the present invention, the bladders 44 are formed by welding a perimeter of two flat sheets of 0.40 inch thick Ti 6-4 and then injecting a pressurized fluid between the flat sheets to superplastically form each bladder 44 to the desired size and shape. For example, as illustrated in FIG. 4A, the bladders 44 can be positioned in the die cavity 18 with a fixture member 46 that defines the desired shape and size of the structural member 12. The fixture member 46 can be formed of a material that remains dimensionally accurate and strong at high temperatures, for example, nickel-chromium alloys such as one of various Inconel® alloys, a registered trademark of Inco Alloys International, Inc. and The International Nickel Company, Inc. The bladders 44 can be positioned with the fixture member 46 and the tools 40, 42 in the die cavity 18 and fluidly connected to a pressurized fluid source 48, such as a pressurized source of argon or another inert gas. The fluid source 48 can be a pressure generation device, such as a compressor, or the source 48 can be a pressure vessel that contains the pressurized fluid. The pressure source 48 can include a pressure regulation device in fluid communication with each of the bladders 44 and configured to maintain a substantially equal pressure in each bladder 44.

The bladders 44 are inflated with the pressurized fluid and expanded to be superplastically formed against the tools 40, 42, the fixture member 46, and/or the dies 14, 16. The bladders 44 can be formed of a material that is superplastically formable at a temperature higher than the heat treatment temperature of the structural member 12. The fixture member 46 can be removed from the die cavity 18, and the structural member 12 can be positioned in the die cavity 18 with one or more of the tools 40, 42 and the formed bladders 44, as shown in FIG. 4. The tools 40, 42, dies 14, 16, and the bladders 44 are then used to restrain the structural member 12 during the heat treatment process as described above.

The structural member 12 is heated to the heat treatment temperature by at least one heater. The heater can comprise any known heating device including, for example, a gas or electric oven. According to one advantageous embodiment of the present invention, at least one of the first and second dies 14, 16 includes at least one susceptor 70, as described more fully below, and the heater comprises an electromagnetic field generator. The electromagnetic field generator can be a plurality of induction coils 50, such as a solenoid coil shown in FIGS. 2 and 5, for inducing a current in the susceptor 70. Each induction coil 50 typically includes a plurality of elongate tube sections 52 that are interconnected by curved tube sections 54 to form coils that are positioned proximate to the die cavity 18 and the corresponding susceptor 70 in which the current is to be induced. The elongate tube sections 52 can be formed, for example, of 1.0 inch diameter copper tubing with a 0.0625 inch wall thickness. The tube sections 52 can alternatively be formed of tubular sections of other sizes and/or with other cross sectional shapes, for example, square or triangular tubes. The tube sections 52 are generally formed of an electrically conductive material such as copper. Lightly drawn copper tubing can be used so that the tube sections 52 can be adjusted as necessary to correspond to the configuration of the corresponding die 14, 16. The tube sections 52 can be positioned relatively close to, such as about 0.75 inches from, the susceptor 70. The curved tube sections 54 are typically disposed outside the dies 14, 16.

Figure 6:
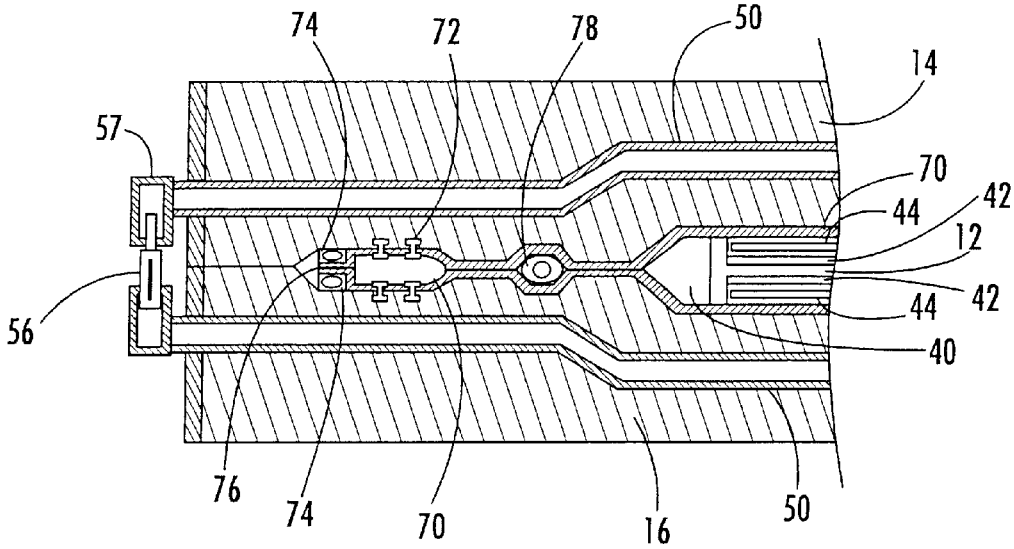
FIG. 6 is a partial section view illustrating the seals and electrical connection pins of the apparatus of FIG. 1, as seen along line 6—6 of FIG. 2.

Each curved tube section 54 can be formed of a flexible, non-conductive material such as plastic, and each tube section 52 can be disposed within only one of the two dies 14, 16 so that the tube sections 52, 54 can form separate fluid paths in the first and second dies 14, 16, i.e., the curved tube sections 54 connect the tube sections 52 to other tube sections 52 that are in the same die 14, 16. The tube sections 52 of the two dies 14, 16 can also be electrically connected by pin and socket connectors 56, 57 as shown in FIG. 6, which can be disconnected when the dies 14, 16 are opened to expose the die cavity 18. The pin and socket connectors 56, 57 are preferably formed of a conductive material such as brass or copper. Thus, the pin and socket connectors 56, 57 maintain electrical conductivity between the tube sections 52 while the generally non-conductive curved sections 54 maintain fluid communication between the tube sections 52. Further, because the tube sections 52, 54 can form separate fluid paths in the first and second dies 14, 16, the dies 14, 16 can be opened without disconnecting the tube sections 52, 54. Therefore, the dies 14, 16 can be separated by disconnecting only the pin and socket connectors 56, 57, which can be quickly and easily connected and disconnected, thus simplifying the opening and closing of the die cavity 18.

The induction coil 50 is capable of being energized by one or more power supplies 58. The power supplies 58 provide an alternating current to the induction coil 50, e.g., between about 3 and 10 kHz. This alternating current through the induction coil 50 induces a secondary current within the susceptor 70 that heats the susceptor 70 and, thus, the structural member 12. The temperature of the susceptor 70 and the structural member 12 can be inferred by monitoring electrical parameters within the one or more power supplies 58, as described in U.S. application Ser. No. 10/094,494, entitled "Induction Heating Process Control," filed Mar. 8, 2002, and which is assigned to the assignee of the present invention and is incorporated herein by reference.

Due to the low electromagnetic absorption of the dies 14, 16, the induction coil 50 induces a current within the susceptor 70 without inducing an appreciable current in the dies 14, 16. Therefore, the susceptor 70 can be heated to high temperatures without heating the dies 14, 16, thereby saving energy and time. Due to the low thermal expansion of the dies 14, 16, the induction coil 50 can be kept relatively cool while the susceptor 70 heats the structural member 12 without inducing stresses in the dies 14, 16 sufficient to cause spalling or otherwise degrading the dies 14, 16. Additionally, the low thermal conductivity of the ceramic dies 14, 16 reduces heat loss from the die cavity 18 and, thus, the structural member 12.

Figure 5:
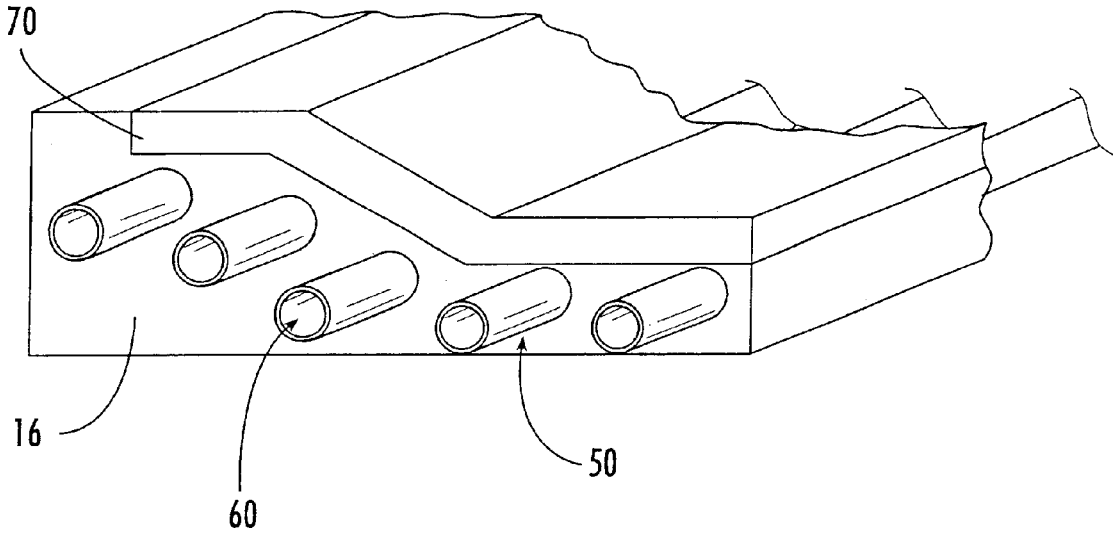
FIG. 5 is a fragmentary perspective view illustrating part of the die and induction coil of the apparatus of FIG. 1.

As illustrated in FIGS. 2 and 5, the induction coil 50 can define a passage 60 for circulating a cooling fluid, such as water, from a coolant source 62. A pump (not shown) circulates the cooling fluid from the coolant source 62 through the passage 60. The cooling fluid cools the induction coil 50 to maintain low electrical resistivity in the coil 50. In addition, by positioning the induction coil 50 uniformly relative to the susceptor 70, the induction coil 50 can be used to heat the susceptor 70 uniformly, and the cooling fluid can be used to transfer thermal energy from the susceptor 70 to cool the susceptor 70.

The at least one susceptor 70 can be cast within the corresponding first and second dies 14, 16 or otherwise disposed thereon. The susceptor 70 is formed of a material that is characterized by a Curie temperature at which the susceptor 70 becomes paramagnetic, for example, a ferromagnetic alloy such as an alloy comprising iron and nickel. Susceptors having Curie temperatures at which each susceptor becomes non-magnetic, or paramagnetic, are described in U.S. Pat. No. 5,728,309 entitled "Method for Achieving Thermal Uniformity in Induction Processing of Organic Matrix Composites or Metals," which issued on Mar. 17, 1998; U.S. Pat. No. 5,645,744 entitled "Retort for Achieving Thermal Uniformity in Induction Processing of Organic Matrix Composites or Metals," which issued on Jul. 8, 1997; and U.S. Pat. No. 5,808,281 entitled "Multilayer Susceptors for Achieving Thermal Uniformity in Induction Processing of Organic Matrix Composites or Metals," which issued on Sep. 15, 1998, each of which is assigned to the assignee of the present invention and is incorporated herein by reference. The susceptor 70 can define a contoured surface and can include an oxidation resistant nickel aluminide coating, which can be flame-sprayed or otherwise disposed on the surface of the susceptor 70. A description of a susceptor with a nickel aluminide coating is provided in U.S. application Ser. No. 10/032,625, entitled "Smart Susceptors with Oxidation Control," filed Oct. 24, 2001, and which is assigned to the assignee of the present invention and is incorporated herein by reference.

Figure 7:
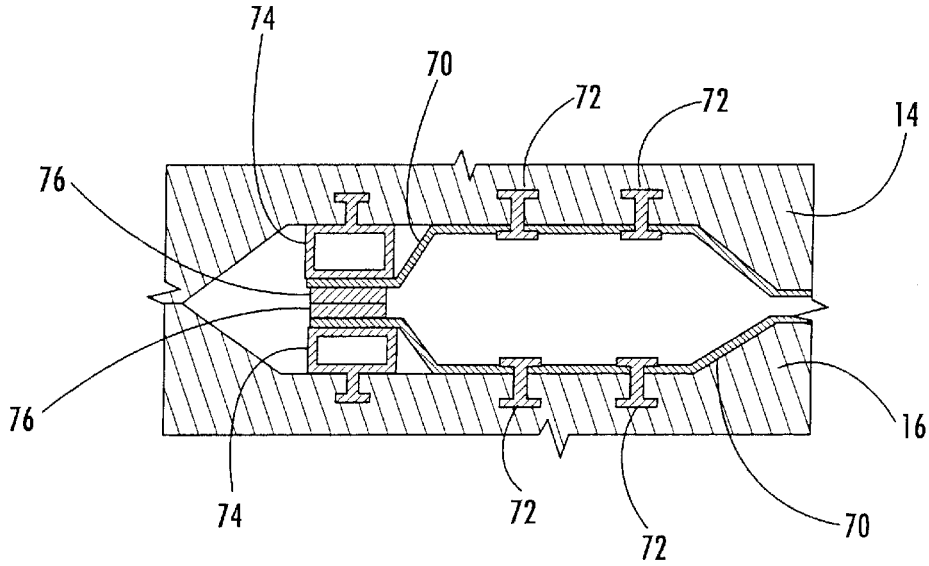
FIG. 7 is an enlarged view of the susceptor seal of FIG. 6.

The susceptors 70 can be provided separately on the first and second dies 14, 16 so that when the dies 14, 16 are opened, the susceptors 70 are also opened and the structural members 12, tools 40, 42, and/or bladders 44 can be inserted or removed from the die cavity 18. As illustrated in FIG. 7, the outer edges of the susceptors 70 can be connected to the respective dies 14, 16 by studs 72, rivets, or other connectors such as screws, bolts, clips, weld joints, and the like. The susceptors 70 can be configured on the dies 14, 16 such that the edges of the susceptors 70 make electrical contact when the dies 14, 16 are closed. Further, one or more inflatable susceptor engagement seals 74 can be used to urge the edges or other portions of the susceptors 70 together and electrically engage the susceptors 70, as shown in FIGS. 6 and 7. The susceptor seals 74, which can be formed of stainless steel, such as 300 series austenitic stainless steel, can extend around the perimeter of the susceptors 70. The susceptor seals 74 can be connected to the dies 14, 16, for example, by the studs 72 or by a T-shaped flange of each seal 74 that engages a corresponding slot in the respective die 14, 16.

Each susceptor seal 74 can be connected to a fluid source (not shown) that provides a pressurized fluid such as compressed air to the susceptor seals 74 and inflates the seals 74 to urge the susceptors 70 together. The fluid source for inflating the susceptor seals 74 can be the fluid source 48 that is used to expand the bladders 44, or a different fluid source can be used. Alternatively, the susceptor seals 74 can be used without a fluid source. For example, each susceptor seal 74 can be deformed against the susceptors 70 when the dies 14, 16 are closed so that the susceptor seals 74 urge the susceptors together. Although two susceptor seals 74 are shown in FIG. 7, a single seal 74 can alternatively be used. For example, the single susceptor seal can urge the edges of both susceptors 70 against a fixed portion of one of the dies 14, 16.

Due to the electrical contact between the susceptors 70, eddy currents induced in the susceptors 70 by the induction coils 50, as explained more fully below, can flow throughout the susceptors 70. Additionally, the susceptors 70 can include contacts 76 that enhance the electrical connection between the susceptors 70, for example, by increasing the durability or oxidation resistance of the susceptors 70 at the interface therebetween. The contacts 76 can be formed of copper, gold, or other electrical conductors that are plated, welded, or otherwise provided on the susceptors 70.

Figure 2A:
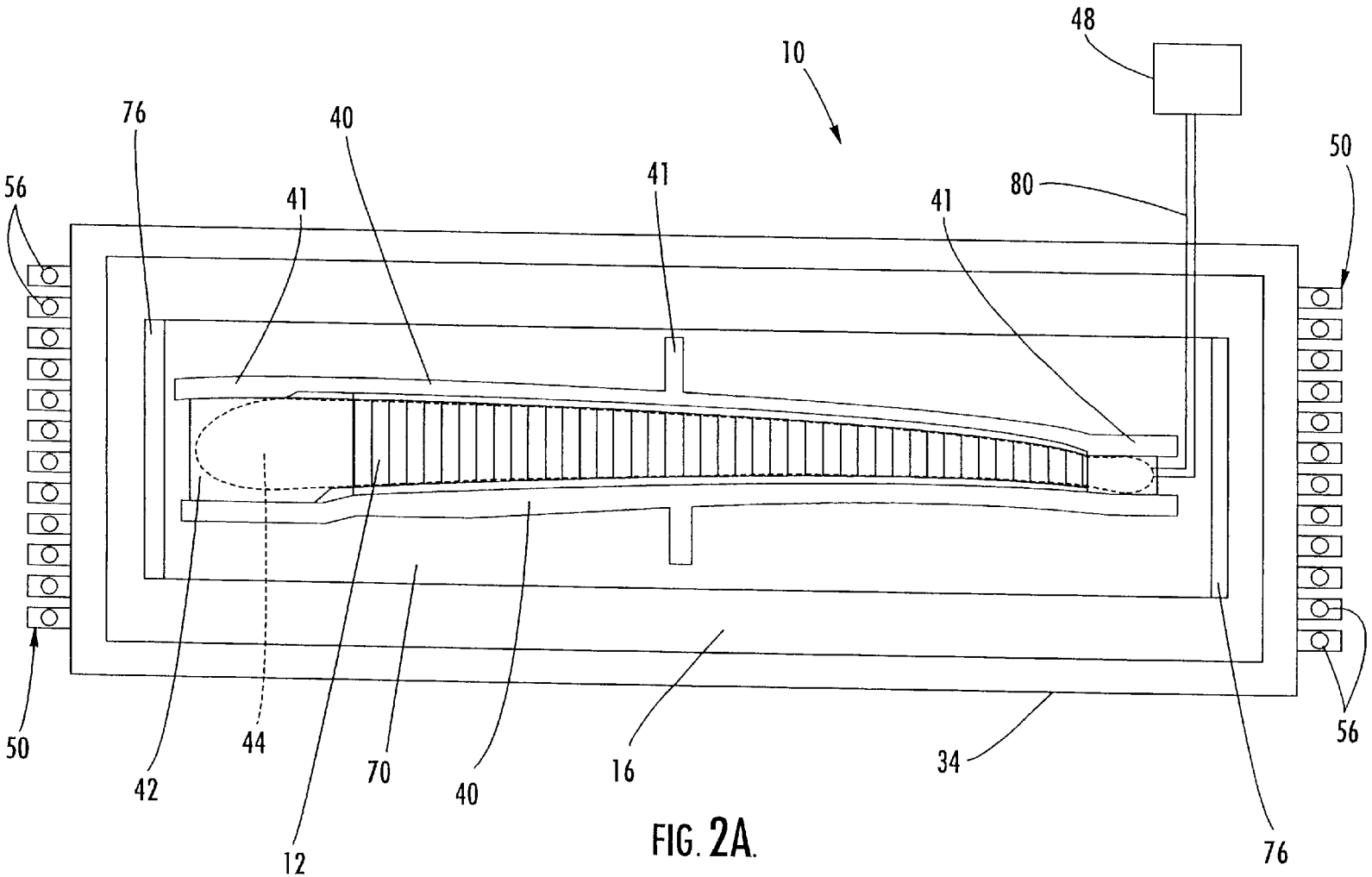
FIG. 2A is a plan view of one die of an apparatus according to another embodiment of the present invention, shown with the die cavity open and with a structural member, tools, and a bladder arranged in the die cavity.
Figure 8:
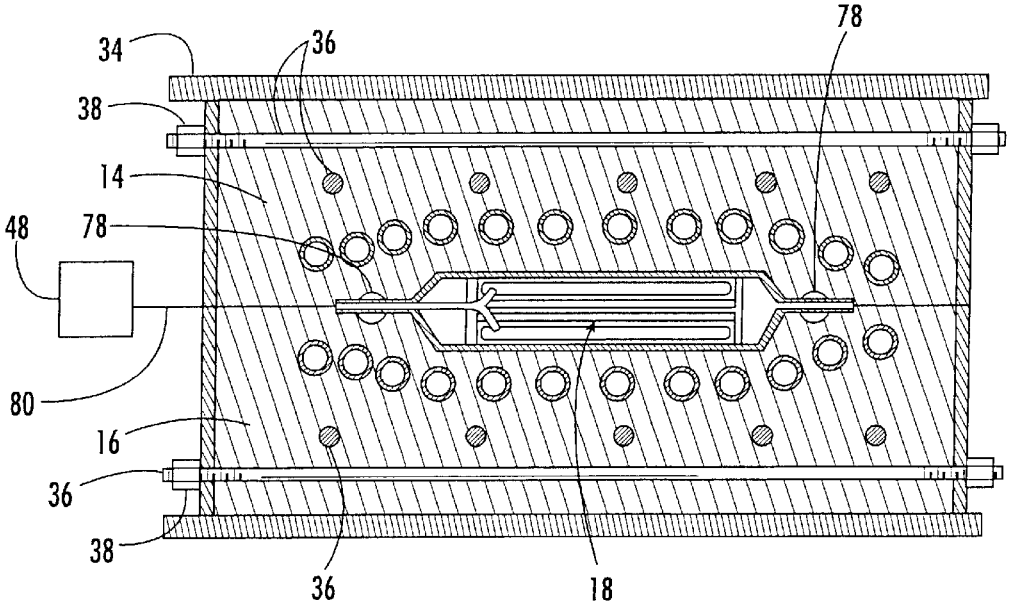
FIG. 8 is a section view of the apparatus of FIG. 1, as seen along line 8—8 of FIG. 2 and shown with the bladders installed and connected to a fluid source.
Figure 9:
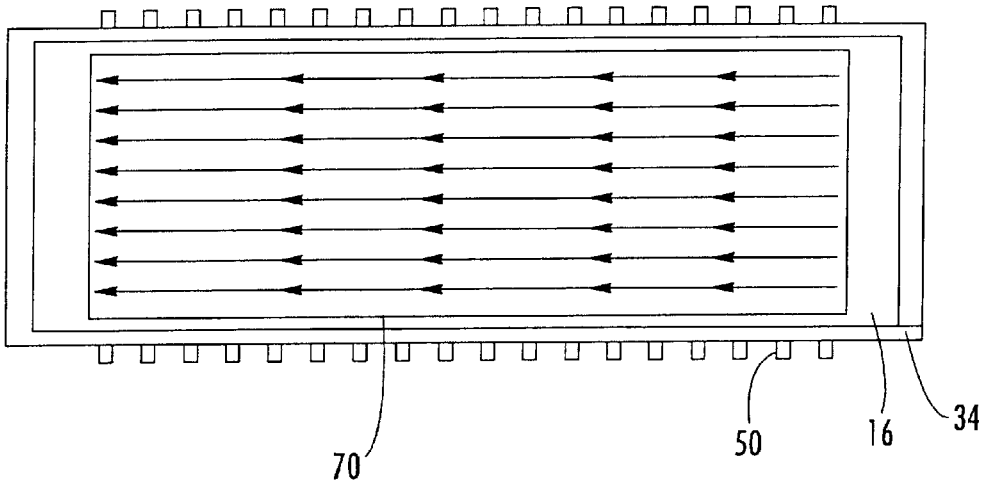
FIG. 9 is plan view illustrating a susceptor having an induced electromagnetic field, according to one embodiment of the present invention.
Figure 10:
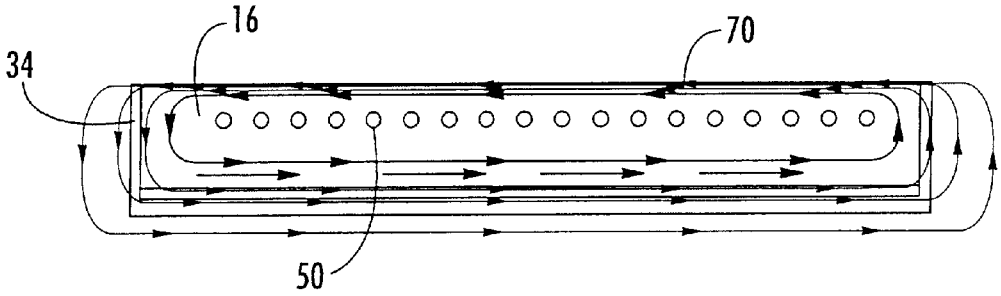
FIG. 10 is an elevation view illustrating the susceptor of FIG. 9.

As shown in FIGS. 6 and 8, the apparatus 10 can also include a cavity seal 78 that is disposed between the dies 14, 16, for example, between the susceptors 70 at a location between the die cavity 18 and the susceptor seals 74. The cavity seal 78 can be a tube-like structure that extends continuously around the die cavity 18 so that the cavity seal 78 can be used to seal the die cavity 18. The cavity seal 78 can be formed of a variety of materials including, but not limited to, metals such as austenitic stainless steel, for example, 304, 316, or 321 stainless steel. Typically, the cavity seal 78 is formed of a material that can operate at the elevated temperatures associated with the heat treatment process. The cavity seal 78 can also be fluidly connected to a fluid source (not shown) that provides a pressurized fluid, such as air, to the cavity seal 78, thereby inflating the cavity seal 78 and urging the cavity seal 78 outwards against the susceptors 70 to form a hermetic seal around the die cavity 18. The fluid source that is used to inflate the cavity seal 78 can be the same fluid source that is used to inflate the susceptor seals 74, the fluid source 48 that is used to expand the bladders 44, or a different fluid source. One or more pipes 80, tubes, or other fluid communication devices can extend through the cavity seal 78, through one of the susceptors 70, or between the cavity seal 78 and one of the susceptors 70 as shown in FIGS. 2A and 8. The pipes 80 fluidly connect the bladders 44 in the die cavity 18 and the pressurized fluid source 48, so that the fluid source 48 can supply fluid to the bladders 44 while the die cavity 18 is sealed by the cavity seal 78 during processing.

Figure 11:
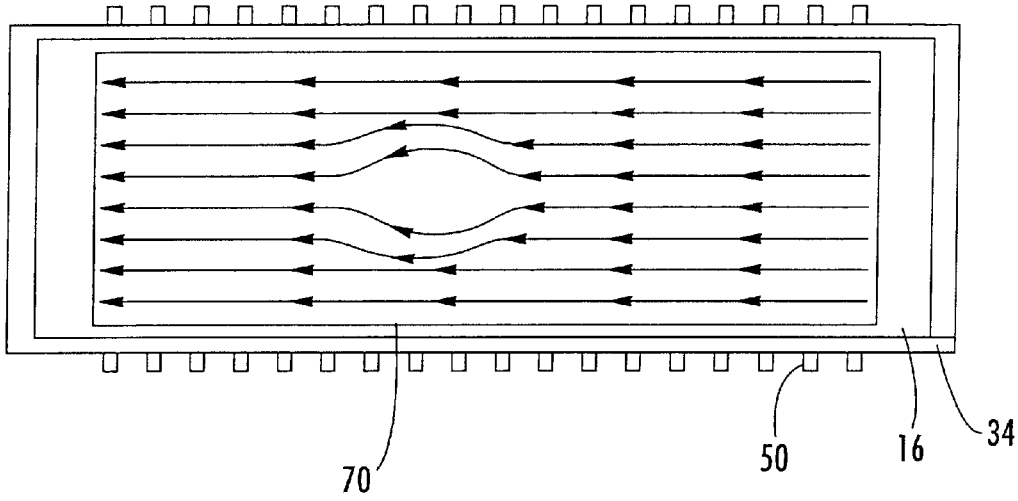
FIG. 11 is a plan view illustrating the susceptor of FIG. 9 wherein a portion of the susceptor has reached its Curie temperature and become paramagnetic.
Figure 12:
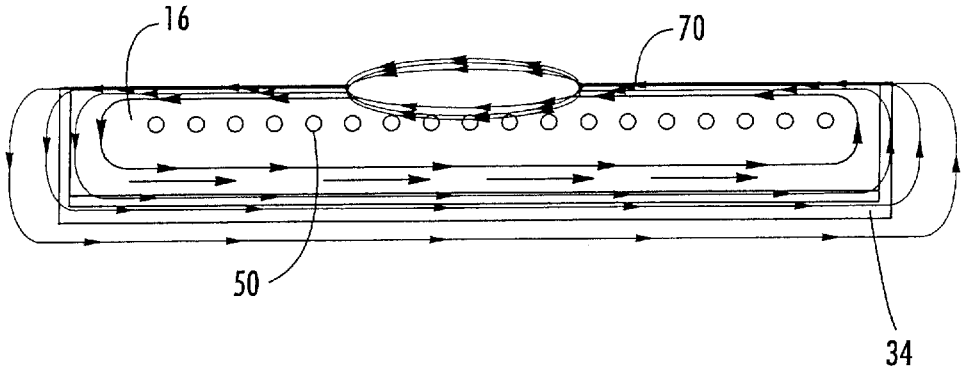
FIG. 12 is an elevation view illustrating the susceptor of FIG. 9 wherein a portion of the susceptor has reached its Curie temperature and become paramagnetic.

As illustrated in FIGS. 9–12, the susceptor 70 is heated through eddy current heating to the Curie temperature of the susceptor 70, whereupon the susceptor 70 becomes paramagnetic and does not heat further. If some portions of the susceptor 70 are heated more quickly than other portions, the hotter portions will reach the Curie temperature and become paramagnetic before the other, cooler portions of the susceptor 70. As illustrated in FIGS. 11 and 12, the eddy currents will then flow through the cooler magnetic portions, i.e., around the hotter, paramagnetic portions of the susceptor 70, causing the cooler portions to also become heated to the Curie temperature. Therefore, even if some portions of the susceptor 70 heat at different rates, the entire susceptor 70 is heated to a uniform Curie temperature. Eddy current heating of the susceptor 70 results from eddy currents that are induced in the susceptor by the electromagnetic field generated by the induction coil 50. The flow of the eddy currents through the susceptor 70 results in resistive heating of the susceptor 70. Preferably, the susceptor 70 acts as a magnetic shield that prevents the induction coil 50 from inducing a current in the structural member 12. As such, the induction coil 50 does not heat the structural member 12 directly, but rather heats the susceptor 70, which, in turn, acts as a heat source in contact with the structural member 12.

The Curie temperature of the susceptor 70 can be equal to the heat treatment temperature of the structural member 12, i.e., the temperature at which the structural member 12 can be heat treated. Thus, the susceptor 70 can be used to heat the structural member 12 uniformly to the heat treatment temperature so that the structural member 12 can be heat treated, for example, to relieve stresses in the structural member 12 that were induced during preceding manufacturing processes. The susceptor 70 can be formed of a variety of materials including cobalt, iron, nickel, and alloys thereof, and the composition of the susceptor 70 can be designed to achieve a desired Curie temperature that is appropriate for a particular type of material. For example, susceptors with Curie temperatures between about 1000° F. and 1500° F. can be used for heat treating structural member that are formed of titanium and some titanium alloys. In one embodiment, the susceptor 70 is formed of 430 F. stainless steel, which typically includes carbon, manganese, phosphorus, sulfur, silicon, chromium, nickel, molybdenum, and iron, for example, approximately 0.065% or less carbon, 0.80% or less manganese, 0.03% or less phosphorous, 0.25% to 0.40% sulfur, 0.30% to 0.70% silicon, 17.25% to 18.25% chromium, 0.60% or less nickel, 0.50% or less molybdenum, and a remaining balance of iron. This alloy has a Curie temperature of about 1240° F., at which temperature titanium and certain titanium alloys can be heat treated. The structural member can be held at the heat treatment temperature for a predetermined period of time, such as about 5 to 60 minutes, and preferably about 20 to 40 minutes for titanium and titanium alloys, and thereby heat treated.

The susceptors 70 can be removable from the dies 14, 16 so that the susceptors 70 can be replaced if they become worn or if it is desired to install susceptors 70 with a different Curie temperature. For example, a first set of susceptors 70 with a Curie temperature corresponding to a forming temperature of the bladders 44 can be installed in the dies 14, 16, and the apparatus 10 can be used to superplastically form the bladders 44 against the fixture member 46 in the die cavity 18, as discussed above in connection with FIG. 4A. The first set of susceptors 70 can then be removed from the die cavity 18, and a second set of susceptors 70 with a Curie temperature corresponding to a relatively lower heat treatment temperature of the structural member 12 can be installed therein. The apparatus 10 can then be used to heat treat the structural member 12, for example, as discussed above in connection with FIG. 4. Thus, the bladders 44 can be formed at a forming temperature to a desired configuration using the fixture member 46, and the formed bladders 44 can then be inserted into the die cavity 18 with the structural member 12 to restrain the structural member 12 during heat treatment.

Figure 13:
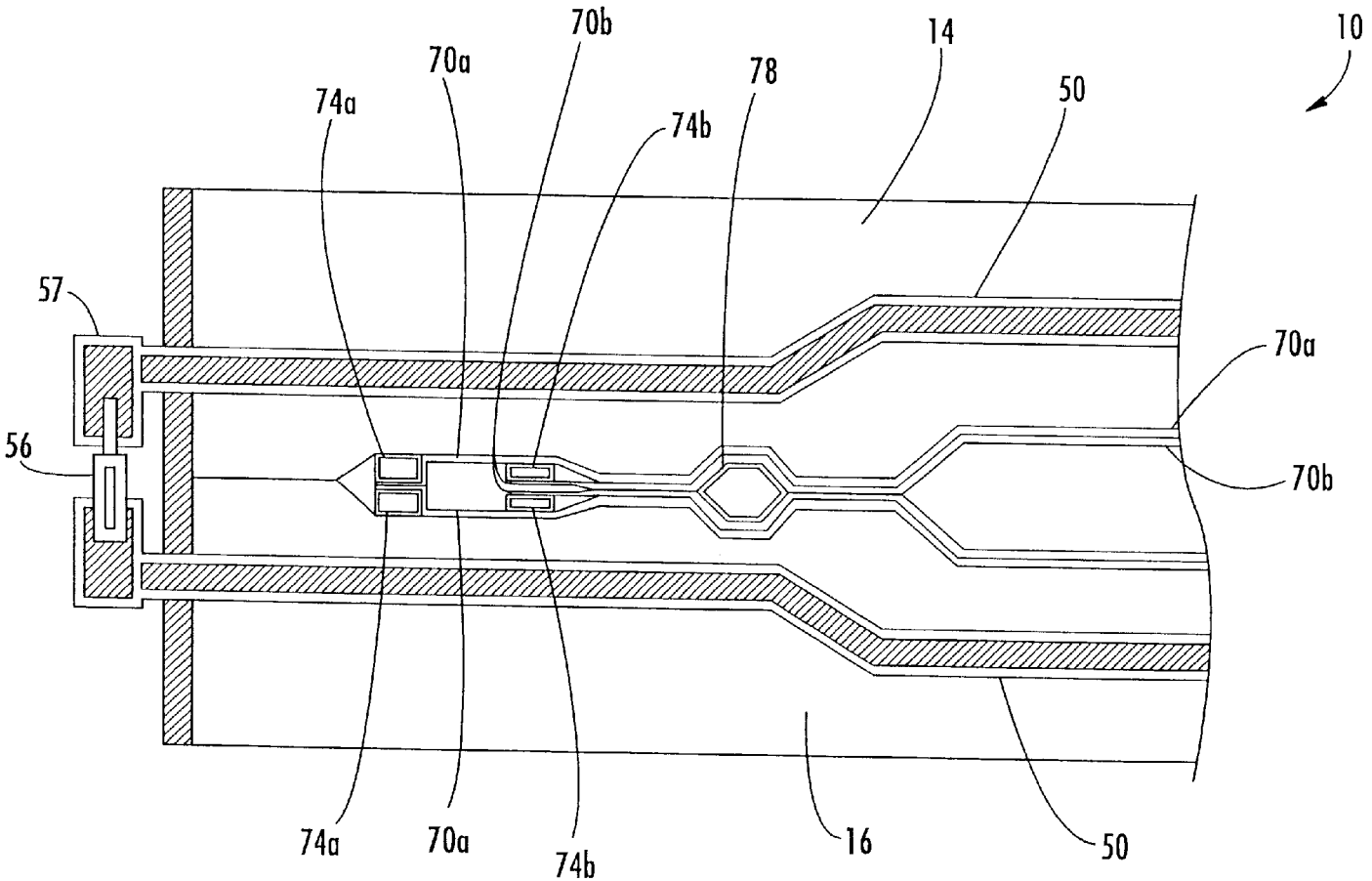
FIG. 13 is a partial section view illustrating an apparatus according to another embodiment of the present invention having two susceptors with different Curie temperatures.
Figure 14:
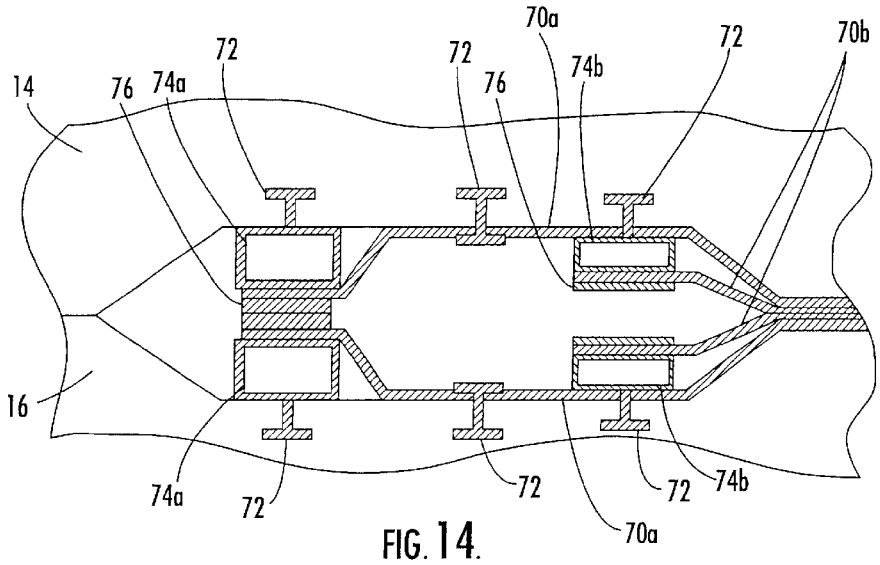
FIG. 14 is an enlarged view of the susceptor seals of FIG. 13, shown with the portions of the first susceptor electrically engaged and the portions of the second susceptor disengaged.
Figure 15:
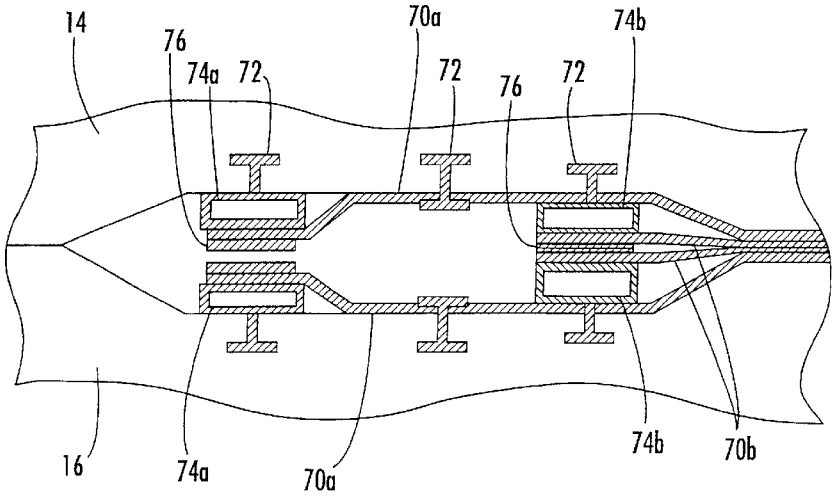
FIG. 15 is an enlarged view of the susceptor seals of FIG. 13, shown with the portions of the second susceptor electrically engaged and the portions of the first susceptor disengaged.

Alternatively, multiple susceptors 70*a*, 70*b* with different Curie temperatures can be provided in the apparatus 10, as shown, for example, in FIGS. 13–15. The first susceptor 70*a* can be disposed on the dies 14, 16 in the die cavity 18, and the second susceptor 70*b* can be disposed on the first susceptor 70*a*. The susceptors 70*a*, 70*b* can be configured so that either of the susceptors 70*a*, 70*b* can be energized by the electromagnetic field generator, e.g., the induction coil 50, to heat the structural member 12 as described above. For example, the first susceptor 70*a* can have a Curie temperature that is equal to the heat treatment temperature of the structural member 12, and the second susceptor 70*b* can have a Curie temperature that is equal to the relatively higher forming temperature of the bladders 44. An insulative layer, such as a thermally sprayed oxide dielectric coating, can be provided between the susceptors 70*a*, 70*b* to electrically isolate the susceptors 70*a*, 70*b*.

Each of the susceptors 70*a*, 70*b* can have multiple portions, such as a first portion disposed on the first die 14 and a second portion disposed on the second die 16. One or more first susceptor engagement seals 74*a* can be used to urge the edges of the portions of the first susceptor 70*a* together to electrically engage the first susceptor portions as shown in FIG. 14. Second susceptor engagement seals 74*b* can be used to urge the edges of the portions of the second susceptor 70*b* together to electrically engage the second susceptor portions as shown in FIG. 15. The first and second susceptor engagement seals 74*a*, 74*b* can be actuated separately by a pressure source as described above. Further, each of the engagement seals 74*a*, 74*b* can be evacuated to disengage each susceptor 70*a*, 70*b*. For example, when the edges of the portions of the first susceptor 70*a* are engaged in FIG. 14, the edges of the portions of the second susceptor 70*b* can be disengaged so that current does not flow between the portions of the second susceptor 70*b*. Similarly, when the edges of the portions of the second susceptor 70*b* are engaged, as shown in FIG. 15, the edges of the portions of the first susceptor 70*a* can be disengaged so that current does not flow between the portions of the first susceptor 70*a*. Thus, the edges of the portions of the first susceptor 70*a* can be disengaged while forming the bladders 44 so that current does not flow between the portions of the first susceptor 70*a*, and the edges of the portions of the second susceptor 70*b* can be disengaged during the heat treatment of the structural member 12 so that current does not flow between the portions of the second susceptor 70*b*. The frequency of the power supply 58 can also be adjusted to efficiently induce a current in one of the susceptors 70*a*, 70*b* while not substantially inducing a current in the other susceptor 70*a*, 70*b*. Further, even if the first susceptor 70*a* is heated during the forming of the bladders 44, the first susceptor 70*a* can be heated to the Curie temperature of the first susceptor 70*a* upon which the first susceptor 70*a* becomes paramagnetic so that the current is induced in the second. susceptor 70*b* and heats the second susceptor 70*b* to the Curie temperature of the second susceptor 70*b*.

Although the bladders 44 may be formed before the heat treatment of the structural member 12, the bladders 44 may undergo some deformation during the heat treatment so that the structural member 12 is urged to, and held in, the desired configuration. For example, as shown in FIG. 4, the bladders 44 are positioned in the die cavity 18 between the cap portions 12*a* of the structural member 12 so that, when the bladders 44 are pressurized during the heat treatment of the structural member 12, each bladder 44 urges the cap portions 12*a* of the structural member 12 outward to a desired configuration. In this way, the structural member 12 can be restrained in a desired configuration defining desired dimensions with narrow tolerances and stress relieved in that configuration so that the resulting heat treated structural member 12 accurately defines the desired dimensions. For example, the cap portions 12*a* can be urged to and restrained in a configuration in which the overall length between the cap portions 12*a* defines a desired length. Further, the bladders 44 can be slightly deformed when inserted into the dies 14, 16 prior to the heat treatment operation, for example, so that the bladders 44 can be fit between the cap portions 12*b* that define a distance therebetween that is smaller than desired. Each bladder 44 can be re-used during multiple heat treatment operations for multiple structural members 12.

Figure 16:
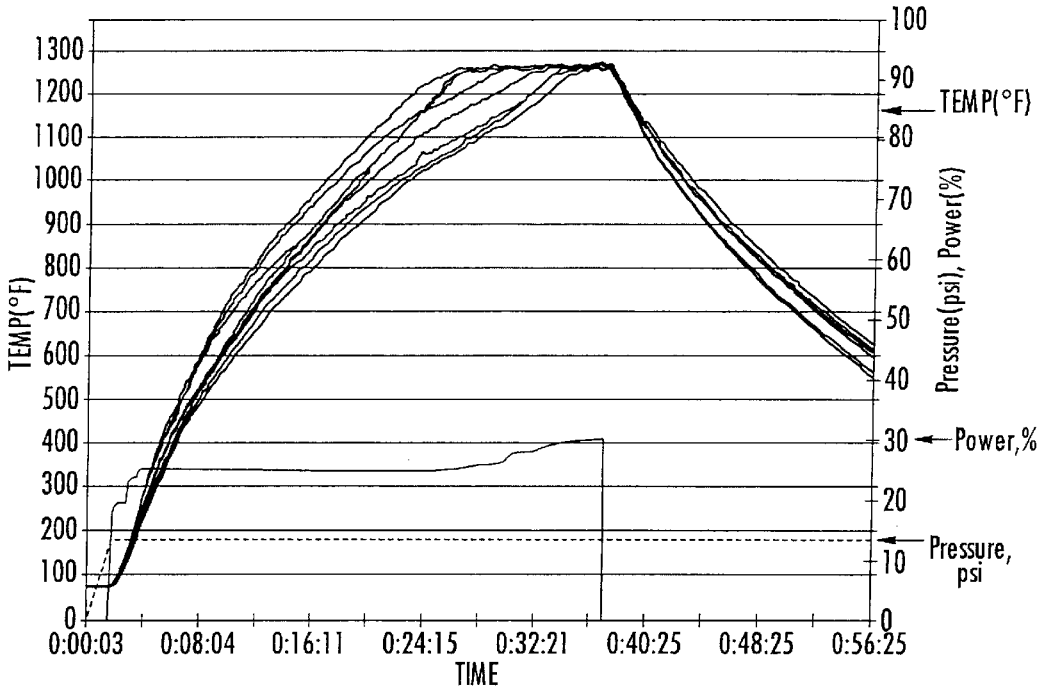
FIG. 16 is a graph illustrating a temperature, pressure, and power profile for heat treating a structural member according to one embodiment of the present invention.

There is shown in FIG. 16 a heat treatment profile for a titanium alloy according to one embodiment of the present invention. FIG. 16 illustrates the pressure variation in the bladders 44, the power variation of the power supply 58,. and the temperature variation of 9 points on the structural member 12 in the die cavity 18 during the heat treatment processes. As illustrated, the pressure in the bladders 44 and the temperature of the structural member 12 begin at initial conditions, which can be ambient conditions. The pressure in the bladders 44 is increased to about 14 psi by injecting gas from the source 48 through the pipe 80 and into the bladders 44. The bladders 44 are expanded by the gas and thereby restrain the structural member 12 in a predetermined configuration. The power supply 58 is energized, generating a current in the induction coils 50 and heating the susceptor 70 and the structural member 12 to the heat treatment temperature, for example, 1250° F., during a period of about 25 to 35 minutes. Although the 9 measured points on the structural member are heated at slightly different rates, each point reaches, and does not substantially exceed, the heat treatment temperature. The structural member 12 is held at the heat treatment temperature for between about 5 and 20 minutes, thereby effecting a stress relief heat treatment of the structural member 12. The output of the power supply 58 is then reduced and the pressure in the bladders 44 is held substantially constant as the structural member 12 cools in the die cavity 18. Output of the power supply 58 can be terminated during cooling, or reduced so that the power supply 58 is used to control the rate of cooling of the structural member 12, for example, according to a predetermined temperature schedule. The structural member 12 can be cooled to the ambient temperature in the apparatus 10 or can be removed after cooling to a temperature below which distortion is unlikely to occur, for example, below about 400° F. Thus, the structural member 12 is held in the desired configuration during the heating and cooling, and distortion of the structural member 12 is prevented. The pressure in the bladders 44 can be released shortly before opening the dies 14, 16.

Figure 17:
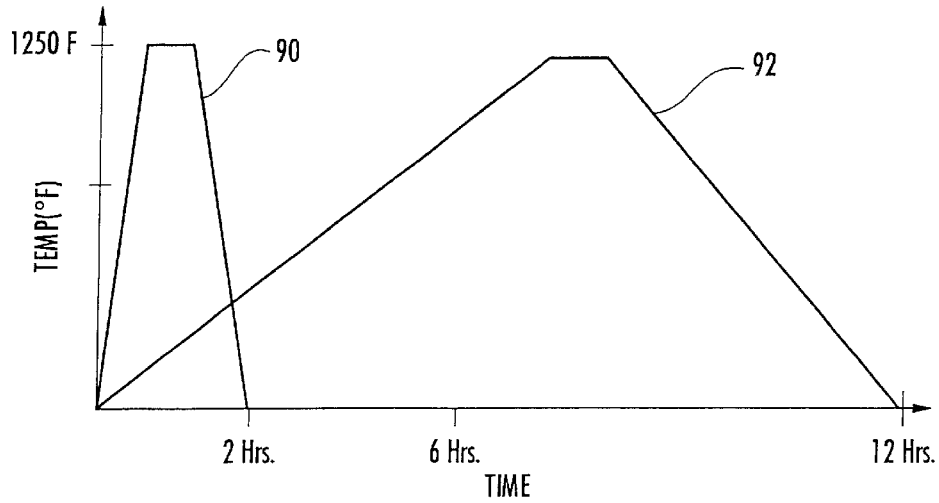
FIG. 17 is graph illustrating a temperature profile for heat treating a structural member according to another embodiment of the present invention, as compared to a conventional temperature profile.

FIG. 17 illustrates a simple temperature profile, designated by reference numeral 90, for heat treating a structural member 12 formed of a titanium alloy to relieve stresses in the structural member 12 according to one embodiment of the present invention. The structural member 12 is heated to a heat treatment temperature of about 1250° F. during a time period of between about 30 and 45 minutes. The structural member 12 is held at the heat treatment temperature for a time period of between about 20 and 40 minutes. The structural member 12 is then cooled at least partially in the die cavity 18. There is also shown in FIG. 17 a temperature profile, designated by reference numeral 92, for a conventional process for stress relief. According to the conventional process, the structural member is heated in a furnace to a heat treatment temperature, held at that temperature, and cooled. However, the conventional process can take up to about 12 hours due, in part, to the relatively longer periods required for heating and cooling the structural member in the furnace.

Figure 18:
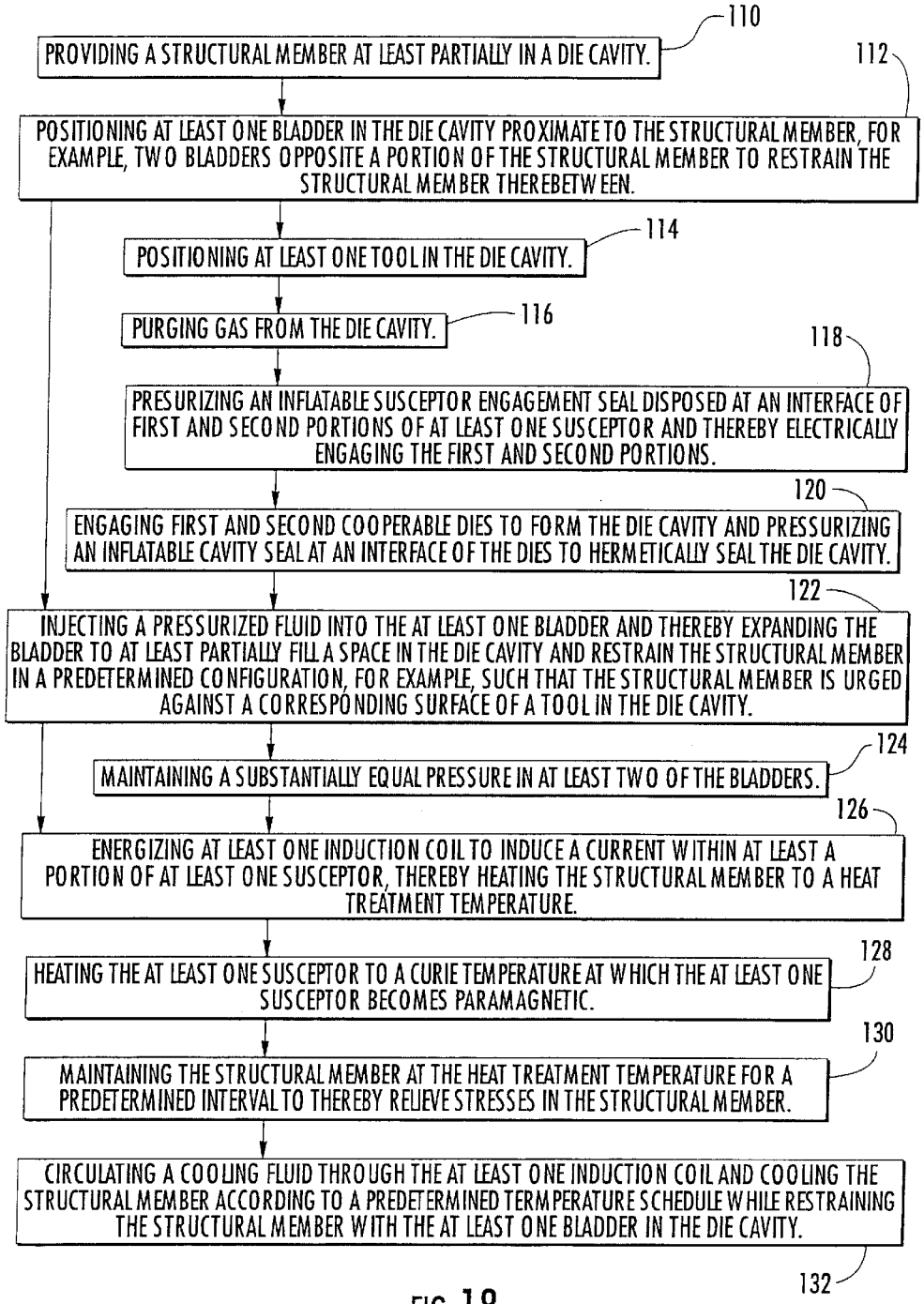
FIG. 18 is a flow chart illustrating the operations performed in heat treating a structural member according to one embodiment of the present invention.

Referring now to FIG. 18, there are illustrated a number of operations, some or all of which can be performed in processing a structural member according to embodiments of the present invention. A structural member is at least partially, and most commonly, completely provided in a die cavity. See block 110. At least one bladder is positioned in the die cavity proximate to the structural member. For example, two or more bladders can be provided, and the bladders can be positioned opposite a portion of the structural member to restrain the structural member therebetween. The bladders can be formed of material such as titanium and titanium alloys. See block 112. At least one tool can be positioned in the die cavity. Each tool can define a surface corresponding to at least a portion of the structural member and can be positioned opposite the structural member from at least one of the bladders. See block 114. Gas can be purged from the die cavity. For example, an inert gas such as argon can alternately be injected into and evacuated from the bladders or other portions of the die cavity so that the gas in the bladders or die cavity is replaced with the inert gas. See block 116. An inflatable susceptor engagement seal can be disposed at an interface of first and second portions of at least one susceptor so that the seal electrically engages the first and second portions. See block 118. First and second cooperable dies can be engaged to form the die cavity and an inflatable cavity seal at an interface of the dies can be pressurized to hermetically seal the die cavity. See block 120. A pressurized fluid is injected into the at least one bladder, expanding the bladder to at least partially fill a space in the die cavity and restrain the structural member in a predetermined configuration. For example, the structural member can be urged against a corresponding surface of a tool in the die cavity. See block 122. If more than one bladder is used, a substantially equal pressure can be maintained in each of the bladders. See block 124. An electromagnetic field generator, such as an induction coil, is energized to induce a current within at least a portion of the at least one susceptor, thereby heating the structural member to a heat treatment temperature. See block 126. The at least one susceptor can be heated to a Curie temperature at which the susceptor becomes paramagnetic. See block 128. The structural member can be maintained at the heat treatment temperature for a predetermined interval to thereby relieve stresses in the structural member. See block 130. A cooling fluid can be circulated through the at least one induction coil, and the structural member can be cooled according to a predetermined temperature schedule while restraining the structural member with the at least one bladder in the die cavity. See block 132.

Figure 19:
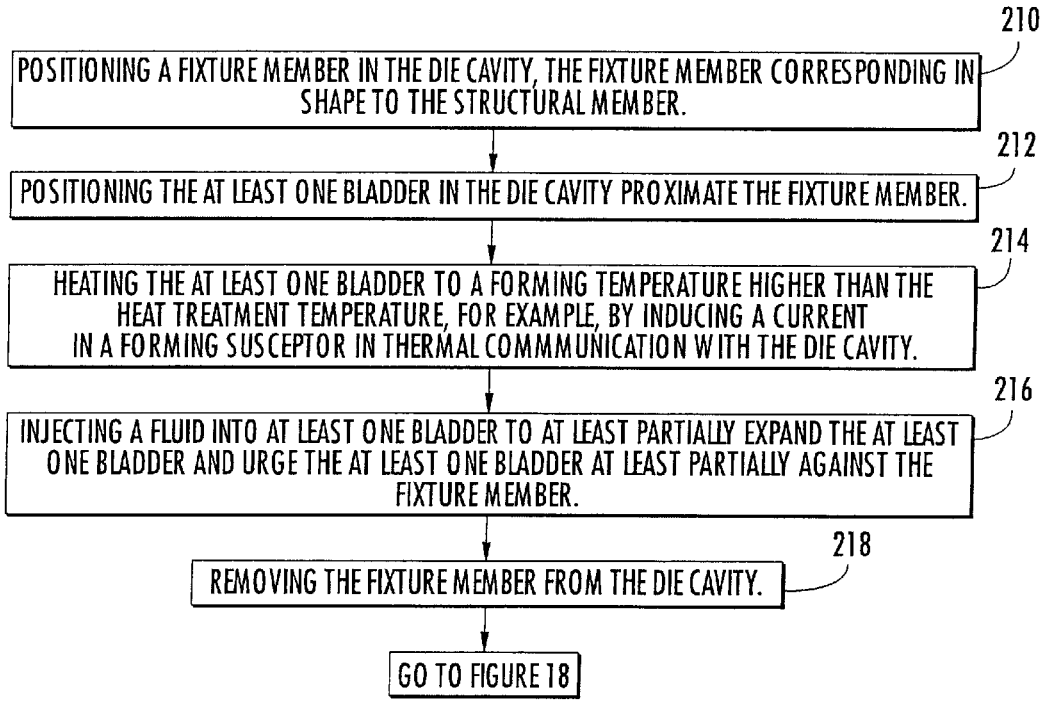
FIG. 19 is a flow chart illustrating the operations performed in heat treating a structural member according to another embodiment of the present invention.

FIG. 19 illustrates the operations performed in processing a structural member according to another embodiment of the present invention. One or more of the operations illustrated in FIG. 19 are performed before one or more of the operations of FIG. 18. For example, a fixture member is positioned in the die cavity. The fixture member corresponds in shape to the structural member. See block 210. At least one bladder is positioned in the die cavity proximate the fixture member. See block 212. The bladders are heated to a forming temperature higher than the heat treatment temperature of the structural member. For example, a forming susceptor can be provided in thermal communication with the die cavity, the forming susceptor having a Curie temperature about equal to the forming temperature of the bladders. A current can be induced in the forming susceptor to heat the bladders to the forming temperature. See block 214. A fluid is injected into the bladders to at least partially expand the bladders and urge the bladders at least partially against the fixture member. See block 216. The fixture member is removed from the die cavity. See block 218. Thereafter, the structural member can be processed according to one or more of the operations described in connection with FIG. 18.

Many modifications and other embodiments of the invention will come to mind to one skilled in the art to which this invention pertains having the benefit of the knowledge presented in the foregoing descriptions and the associated drawings. For example, the structural member 12 can be aged according to a predetermined aging schedule in the apparatus 10 following the stress relief cycle by heating the structural member to an aging temperature and holding the structural member at the aging temperature for a predetermined period before cooling. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for heat treating a structural member, the apparatus comprising:

first and second co-operable dies structured to define a die cavity therebetween for at least partially receiving the structural member;

at least one susceptor in thermal communication with said die cavity, each susceptor having a Curie temperature at which said susceptor becomes paramagnetic;

an electromagnetic field generator configured to induce a current within at least a portion of said at least one susceptor;

at least one bladder positioned in said die cavity, each said bladder configured to receive a pressurized fluid for expanding said bladder; and at least one rigid tool disposed in said die cavity, said tool defining a contour surface corresponding to the structural member, wherein said at least one bladder is configured to urge said at least one tool against the structural member and thereby restrain a distortion of the structural member while the structural member is heat treated.

2. An apparatus according to claim 1 wherein said at least one tool is disposed in said die cavity between said at least one bladder and the structural member.

3. An apparatus according to claim 1 wherein said at least one tool is disposed in said die cavity between at least one of said dies and the structural member.

4. An apparatus according to claim 1 wherein the Curie temperature of said at least one susceptor is about equal to the heat treatment temperature of the structural member.

5. An apparatus according to claim 1 further comprising a coolant source and wherein said electromagnetic field generator is at least one induction coil, said coolant source being fluidly connected to a passage defined by said at least one induction coil and configured to circulate a cooling fluid through said passage and cool said at least one induction coil.

6. An apparatus according to claim 1, further comprising a pressure source fluidly connected to said at least one bladder and configured to supply the pressurized fluid to said at least one bladder.

7. An apparatus according to claim 1 wherein at least two of said bladders are positioned in said die cavity and further comprising a pressure regulation device in fluid communication with each bladder, said pressure regulation device configured to maintain a substantially equal pressure in each bladder.

8. An apparatus according to claim 1 wherein at least two of said bladders are positioned in said die cavity and configured opposite a portion of the structural member such that said bladders restrain the structural member therebetween.

9. An apparatus according to claim 1 wherein at least one of said bladders is positioned in said die cavity and configured between opposed portions of the structural member such that said bladders urge the opposed portions to a predetermined dimension.

10. An apparatus according to claim 1 wherein each bladder comprises at least one of the group consisting of titanium and titanium alloys.

11. An apparatus according to claim 1 further comprising an inflatable susceptor engagement seal disposed at an interface of first and second portions of the at least one susceptor and configured to be inflated to electrically engage the first and second portions.

12. An apparatus according to claim 1 further comprising an inflatable cavity seal disposed at an interface of said first and second dies and configured to receive a pressurized fluid to inflate said seal and hermetically seal the die cavity.

13. A method of heat treating a structural member, the method comprising:

providing the structural member at least partially in a die cavity;

positioning at least one bladder in the die cavity proximate to the structural member;

positioning at least one tool in the die cavity proximate to the structural member, each tool defining a surface corresponding to at least a portion of the structural member;

injecting a pressurized fluid into the at least one bladder and thereby expanding the bladder to at least partially fill a space in the die cavity and restrain the structural member in a predetermined configuration against the corresponding surface of the at least one tool; and energizing an electromagnetic field generator to induce a current within at least a portion of at least one susceptor, thereby heating the structural member to a heat treatment temperature, wherein the structural member is restrained by the at least one bladder during at least part of said energizing step such that the bladder restrains a distortion of the structural member.

14. A method according to claim 13 wherein said first positioning step comprises positioning at least two of the bladders in the die cavity opposite a portion of the structural member such that the bladders restrain the structural member therebetween during at least a portion of said energizing step.

15. A method according to claim 13 wherein said energizing step comprises heating the at least one susceptor to a Curie temperature at which the at least one susceptor becomes paramagnetic.

16. A method according to claim 13 wherein said energizing step comprises maintaining the structural member at the heat treatment temperature for a predetermined interval to thereby relieve stresses in the structural member.

17. A method according to claim 13 wherein said energizing step comprises electrically energizing at least one induction coil and further comprising circulating a cooling fluid through the at least one induction coil.

18. A method according to claim 13 further comprising cooling the structural member according to a predetermined temperature schedule while restraining the structural member with the at least one bladder in the die cavity.

19. A method according to claim 13 wherein said injecting step comprises maintaining a substantially equal pressure in at least two of the bladders.

20. A method according to claim 13 further comprising providing the at least one bladder, each of the bladders comprising at least one of the group consisting of titanium and titanium alloys.

21. A method according to claim 13 further comprising purging gas from the die cavity prior to said heating step.

22. A method according to claim 13 further comprising pressurizing an inflatable susceptor engagement seal disposed at an interface of first and second portions of the at least one susceptor and thereby electrically engaging the first and second portions.

23. A method according to claim 13 further comprising engaging first and second cooperable dies to form the die cavity and pressurizing an inflatable cavity seal at an interface of the dies to hermetically seal the die cavity.

24. A method according to claim 13 wherein said second positioning step comprises positioning the at least one tool in the die cavity opposite the structural member from at least one of the bladders such that the bladder urges the structural member against the corresponding surface of the tool.

25. A method according to claim 13 further comprising, prior to said providing step:

positioning a fixture member in the die cavity, the fixture member corresponding in shape to the structural member;

positioning the at least one bladder in the die cavity proximate the fixture member;

heating the at least one bladder to a forming temperature higher than the heat treatment temperature;

injecting a fluid into at least one bladder to at least partially expand the at least one bladder and urge the at least one bladder at least partially against the fixture member; and removing the fixture member from the die cavity.

26. A method according to claim 25 further comprising providing a forming susceptor in thermal communication with the die cavity, said forming susceptor having a Curie temperature about equal to the forming temperature, and inducing a current in the forming susceptor to heat the bladder to the forming temperature.

27. A product obtained by the method of claim 13.

28. A product according to claim 13 wherein the product is formed of at least one of the group consisting of titanium and titanium alloys.

* * * * *

UNITED STATES PATENT AND TRADEMARK OFFICE

CERTIFICATE OF CORRECTION

PATENT NO. : 6,747,253 B1
DATED : June 8, 2004
INVENTOR(S) : Firth et al.

It is certified that error appears in the above-identified patent and that said Letters Patent is hereby corrected as shown below:

Title page,
Item [56], References Cited, U.S. PATENT DOCUMENTS, insert the following:

-- 5,603,449 2/1997 Mansbridge et al. --.

Signed and Sealed this

Twenty-fourth Day of August, 2004

JON W. DUDAS
*Director of the United States Patent and Trademark Office*